United States Patent [19]

Jensen

[11] Patent Number: 5,052,125

[45] Date of Patent: Oct. 1, 1991

[54] METHOD AND APPARATUS FOR SUPPORTING STRAND

[75] Inventor: Thomas H. Jensen, Murrysville, Pa.

[73] Assignee: PPG Industries, Inc., Pittsburgh, Pa.

[21] Appl. No.: 588,623

[22] Filed: Sep. 26, 1990

[51] Int. Cl.[5] ..... F26B 13/00

[52] U.S. Cl. ..... 34/23; 34/156; 34/160

[58] Field of Search ..... 34/23, 155, 156, 154, 34/160, 10; 226/97

[56] References Cited

U.S. PATENT DOCUMENTS

| | | | |
|---|---|---|---|
| 2,005,580 | 6/1935 | Ferre | 34/48 |
| 2,099,162 | 11/1937 | Eberlin | 34/18 |
| 2,255,859 | 9/1941 | Quigley | 34/155 |
| 3,619,252 | 11/1971 | Roscher | 117/66 |
| 3,622,058 | 11/1971 | Vits | 34/156 |
| 3,680,218 | 8/1972 | Belue et al. | 34/10 |
| 3,718,983 | 3/1973 | Crowell | 34/156 |
| 3,750,302 | 8/1973 | Smith | 34/154 |
| 3,827,639 | 8/1974 | Relue et al. | 239/552 |
| 3,914,477 | 10/1975 | Belue et al. | 427/378 |
| 3,982,328 | 9/1976 | Gustafsson et al. | 34/156 |
| 4,154,005 | 5/1979 | Pickering et al. | 34/155 |
| 4,218,830 | 8/1980 | Grassmann | 34/1 |
| 4,290,210 | 9/1981 | Johansson | 34/156 |
| 4,292,745 | 10/1981 | Caratsch | 34/156 |
| 4,425,719 | 1/1984 | Klein et al. | 34/156 |
| 4,498,250 | 2/1985 | Gageur et al. | 34/155 |
| 4,603,490 | 8/1986 | Hilmersson et al. | 34/155 |
| 4,698,914 | 10/1987 | Shu et al. | 34/10 |
| 4,718,178 | 1/1988 | Whipple | 34/156 |
| 4,750,715 | 6/1988 | Harada et al. | 34/156 |
| 4,753,777 | 6/1988 | Yoshinari et al. | 422/150 |
| 4,833,794 | 5/1989 | Stibbe et al. | 34/156 |
| 4,863,761 | 9/1989 | Puri | 427/175 |

*Primary Examiner*—Henry A. Bennett
*Assistant Examiner*—Denise L. F. Gromada
*Attorney, Agent, or Firm*—Andrew C. Siminerio

[57] ABSTRACT

The present invention provides a method and apparatus for supporting a strand. The strand is positioned between a pair of nozzles that are tilted towards each other such that an upwardly directed gas stream issuing from the first nozzle intersects an upwardly directed gas stream issuing from the second nozzle along a line which along with the strand, forms a generally vertical plane. The combined upwardly directed force from the gas streams lifts and supports the strand while the opposing lateral force from each gas stream on the strand tend to reduce and lateral movement and stabilize its relative position.

13 Claims, 3 Drawing Sheets

METHOD AND APPARATUS FOR SUPPORTING STRAND

OBJECT OF THE INVENTION

1. Field of the Invention

This invention relates to supporting an advancing strand of material and is particular useful in supporting coated strands of fiber glass filaments as they pass through an oven to dry and cure the coating.

2a. Technical Considerations

Fiber glass, which was originally developed in the 1930s, has been used over the years as fibrous strand and yarns in numerous end uses, such as textiles, reinforcement polymeric matrices, and rubber goods. Glass fibers are traditionally produced through attenuation from small orifices in a bushing of a glass batch melting furnace. The glass fibers issue forth from the orifices in molten streams and are cooled and treated with a sizing composition. The sizing composition is ordinarily an aqueous composition having, e.g. coupling agents, lubricants and film-forming polymer components. The sized glass fibers are gathered into one or more bundles of fibers or strands and wound into a forming package or chopped. For textile applications, the bundles of fibers in the forming packages can be twisted and/or combined with other strands to form yarns. When the glass fibrous strands from the forming packages are used for reinforcement of rubber goods, a second chemical treatment or coating is usually applied to the strands to make the strands or bundles of strands compatible with the rubber matrix. In this latter application, the elastomer coating is generally applied by passing the strands through a vessel containing a solution or liquid dip containing the elastomer. The wet or saturated glass fiber strands are then supported and conveyed under slight tension over rollers or the like as they pass through a heated atmosphere to dry and/or cure the elastomer coating. Some of the problems which arise with this type of arrangement include difficulties in processing the coated glass fiber strands over conveyor rolls, pulleys and the like without stripping off coating material and/or without depositing coating material on the conveying and supporting elements and maintaining the coated product cross section during processing. Contact with guides and support rolls may result in buildup of coating material on guides and supports which generally degrades the coated product and may result in the coated fibers moving out of the guides and sticking together.

One way to avoid these problems is to provide a non-contact support for the strand within the oven. For example, an air knife assembly may be positioned below the coated strands to deliver a vertically directed sheet of air to support the strands. However, the air streams to not provide any resistance to lateral movement by the strands so that the strands may vibrate or move laterally within the oven and contact an adjacent strand. In an effort to maintain the separation between adjacent strands, the air knife assemblies may include vertical comb members positioned between adjacent coated strands to maintain the individual strands in spaced apart relationship from each other as they advance through the oven and prevent uncured product which may still have a tacky surface from sticking to other coated strands. However, the comb arrangement does not inhibit but rather only limit the lateral movement of the strands by imposing a physical barrier to the lateral movement and further, if the strands contact the comb, some of the coating may be deposited on the comb members resulting in both coating build-up on the comb as well as degradation of the coated strand.

2b. Patents of Interest

U.S. Pat. No. 3,619,252 to Roscher discloses coating and impregnating glass fibers with an aqueous elastomer composition and then drying the coated product with high frequency electrical heaters to remove the water while not affecting the remaining elastomer solids. The coated fiber glass passes vertically through a dielectric heater where undesirable volatile constituents of the coating are removed. The strand then makes multiple passes through a hot gas oven to cure the coating.

U.S. Pat. Nos. 3,680,218 and 3,914,477 to Belue et al. disclose a method of supporting and drying coated strands. The individual strands are exposed to jets of heated air from opposing slotted nozzles that are staggered relative to each other. The nozzles produce curtains of hot air on both sides of the strand that dry the coating while suspending the coated bundles between the nozzles.

U.S. Pat. No. 3,750,302 to Smith discloses an apparatus for supporting a plurality of filaments. The strands advance over a planar surface that has a transverse slot across its width. A heated pressurized fluid issues from the slot and is directed along the planar surface to provide a cushion of fluid to support the overlying filaments.

U.S. Pat. No. 4,292,745 to Caratsch discloses an air foil dryer for drying webs of material. Upper and lower nozzle assemblies are positioned on opposite sides of the web in staggered relationship to each other. The drying air from the lower nozzle forms an air cushion that helps support the web.

U.S. Pat. No. 4,698,914 to Shu et al. discloses a process for drying a flexible coated web. A series of air bags and air foils are positioned below the advancing web to float the web in a substantially flutter-free condition.

SUMMARY OF THE INVENTION

The present invention provides a method and apparatus for supporting a strand. The strand is positioned between a pair of nozzles that are tilted towards each other such that an upwardly directed gas stream issuing from the first nozzle intersects an upwardly directed gas stream issuing from the second nozzle along a line which along with the strand, forms a generally vertical plane. The combined upwardly directed force from the gas streams lifts and supports the strand while the opposing lateral force from each gas stream on the strand tend to reduce any lateral movement and stabilize its relative position. In one particular embodiment of the invention, the strand is a coated fiber glass strand that advances through a drying and curing oven. The strand is supported at one end when the coating is applied and at its opposing end after the coating has been dried. The support arrangement of the present invention supports the strand within the oven, intermediate of these end supports, without any physical contact therewith so as to maintain the shape and integrity of the coated strand during the drying and curing operation.

DETAILED DESCRIPTION OF THE INVENTION

The present invention is disclosed in combination with drying and/or curing strands of fiber glass filaments coated with polymeric chemical coatings, but it should be understood that the present invention can be used in any type of operation that requires support of an elongated member, such as e.g., strands, yarns, cords or the like.

Although not limiting in the present invention, in the particular embodiment discussed herein, the glass fibers are produced from any fiberizable glass batch composition and formed into glass fibers such as "E-glass" fibers, "621 glass" fibers, "A-glass" fibers, "S-glass" fibers, "C-glass" fibers and low fluorine and/or boron derivatives thereof. However, other coated materials such as carbon, graphite, nylon, polyester, polyaramid, steel and the like may be dried in accordance with the teachings of the present invention. The glass fibers are drawn from orifices in a bushing of a glass batch melting furnace and when they have cooled sufficiently, a sizing composition can be applied to them. The glass fibers can be mechanically attenuated or prepared by any other method known to those skilled in the art. The sizing composition can be applied to the glass fibers by any method known to those skilled in the art, such as belts, rollers, sprays and the like.

For glass fibers, the sized glass fibers are gathered into bundles or strands of glass fibers containing from 200 to over 3,000 filaments. The strands are collected, usually by winding onto a forming package or into a precision wound package of roving.

Figure 1:
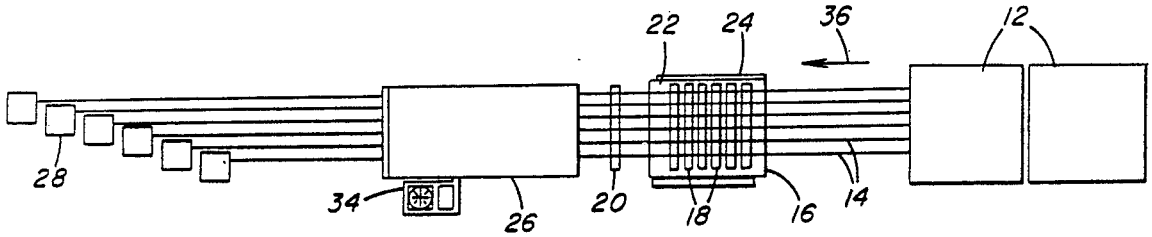
FIG. 1 is a plan view of a fiber coating arrangement and drying/curing oven.

Referring to FIG. 1, a creel 12 includes a plurality of bobbins or forming packages (not shown) containing fiber glass strand 14. In the case of drawing the strand from bobbins, each strand 14 has imparted therein a twist to provide strand integrity and resistance to fuzzing during the initial handling and processing prior to being coated and impregnated with an elastomeric material.

The strands 14 are drawn from the packages in creel 12 in parallel relation and pass through a guide 16 in tangent contact across motor driven rotating rollers or dip applicators 18 to a motor driven rotating wiper roller or guide 20. The dip applicators 18 are partially suspended in an aqueous rubber dip or emulsion 22 contained within vessels or tanks 24. The dip applicators 18 are driven counter to the direction of travel of the strand 14 to improve the coating and impregnation thereof. The pickup of the rubber dip 22 by the applicators 18 and strand 14 is more than sufficient to coat and impregnate the strands 14 with the desired final amount of rubber dip 22. The wiper roller or guide 20 is driven counter to the direction of travel of the strand 14 and serves to further impregnate the strand and/or removing excess rubber dip 22 from the coated strand 14.

After coating, the strand 14 enters drying oven 26. If desired, several coated strands can be combined to form a larger bundle and, if necessary, be drawn through a forming die (not shown) to combine and form the bundle as well as remove excess coating material. After drying and curing, the coated strands 14 are wound onto a series of Lessona winders 28 or any other type of strand storing device known in the art, e.g., spindles or a textile winding frame.

Figure 2:
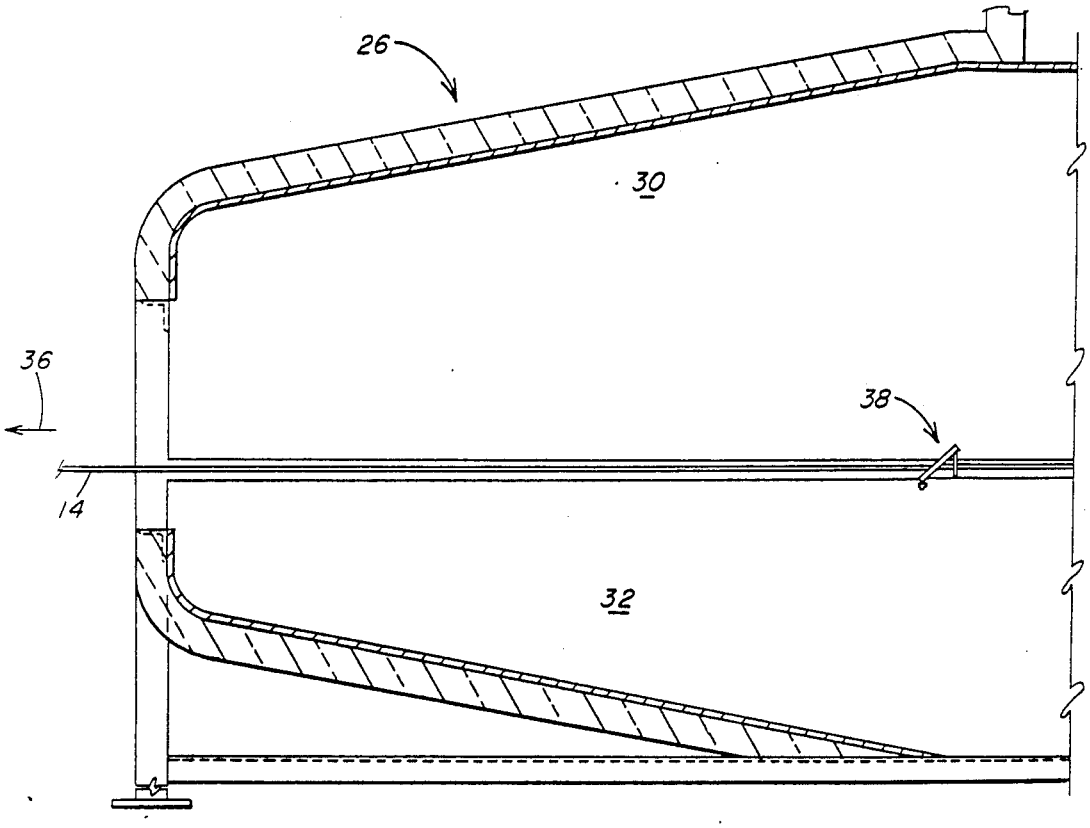
FIG. 2 is an enlarged elevational view of the oven illustrated in FIG. 1, incorporating features of the present invention, with portions removed for clarity.

Referring to FIGS. 1 and 2, the strands 14 progress through the oven 26 which dries and cures the coating on the strand 14. The oven 26 may be of any type known in the art to dry and cure coated strand such as that disclosed in U.S. Pat. No. 4,863,761 to Puri which utilizes controlled air flow through a convective flow tunnel to dry the strand or U.S. Pat. No. 07/589,223 to Jensen which utilizes deflector plates to direct the flow of hot air or gas within an oven to increase the effectiveness of the gas as the drying/curing medium, both of which are incorporated by reference. Although not limiting in the present invention, in the particular embodiment of the oven 26 illustrated in FIG. 2, hot air is circulated between upper plenum 30 and lower plenum 32, with the strand 14 advancing therebetween, by a blower 34.

The drying oven 26 is oriented such that the strand 14 passes therethrough in a horizontal direction as indicated by arrow 36 so that means are required to support the strand 14 to reduce sagging of the strand during drying. If desired, support rolls (not shown) may be positioned along the path of the strand to support it as it advances through the oven 26. However, since such rolls must physically contact the strand 14 to provide the desired support, this contact may change the shape of the coated strand 14 and/or remove some of the coating from the strand 14, resulting in buildup of the coating at the contact points. Therefore, it is preferred that the strand be supported by a non-contact strand support assembly 38, which is the subject of the present invention.

Figure 3:
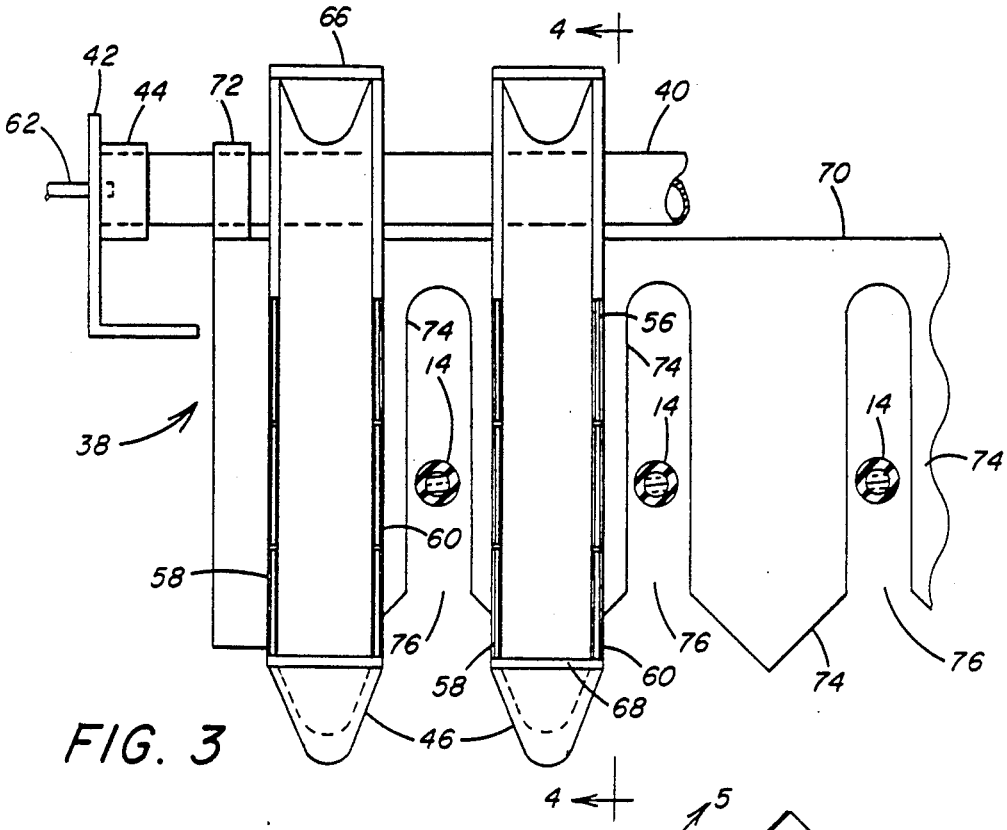
FIG. 3 is a partial elevational view taken along line 3—3 of FIG. 2 showing the strand support arrangement.
Figure 4:
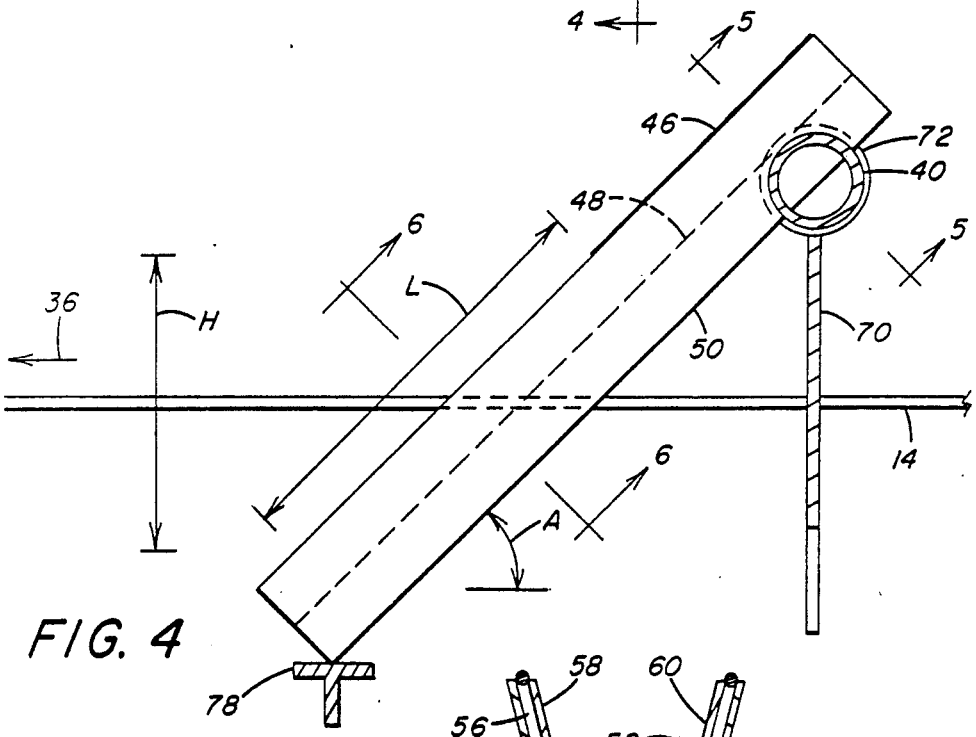
FIG. 4 is a view through line 3—3 of FIG. 3, with portions removed for clarity.
Figure 5:
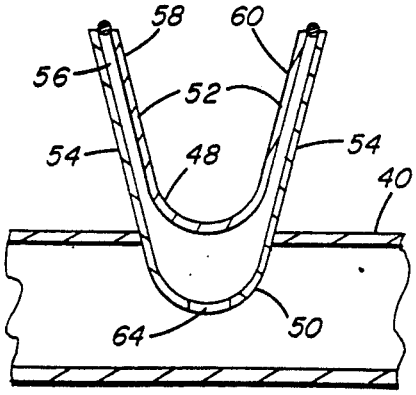
FIG. 5 is a view taken along line 5—5 of FIG. 3, with portions removed for clarity.

Although not limiting in the present invention, in the particular embodiment of the support assembly 38 illustrated in FIGS. 3–5, the support assembly 38 includes an air supply header 40 which is pivotally mounted from support member 42 by collar assembly 44 such that it is positioned above and generally transverse to the coated strands 14. A plurality of nozzle assemblies 46 extend downwardly from the header 40 in a generally spaced apart and parallel orientation to provide clearance therebetween for each strand 14. Although not limiting in the present invention, each nozzle assembly 46 includes a pair of U-shaped members 48 and 50. Header 40 is scalloped to receive member 50, which is secured to the header 40 so as to hold the assembly 46 in place. The spacing between legs 52 of member 48 is slightly less than the spacing between legs 54 of member 50 so that when the members are mated and secured to each other as shown in FIG. 5, a narrow gap provides a nozzle opening 56 between each pair of adjacent legs, forming a pair of nozzles 58 and 60. The width of the nozzle opening 56 is generally between 0.010 and 0.020 inches (0.25 to 0.50 mm) depending on the material being dried and the volume of air provided through header 40. Although not limiting in the present invention, in one particular embodiment, the width of opening 56 was 0.020 in (0.50 mm) and the air flow through the support assembly 38 was 20 to 40 CFM (0.57 to 1.13 $m^3$ per min). Air provided from a pressurized air source (not shown) is pumped through fitting 62 at collar assembly 44 into header 40. The pressurized air then passes through opening 64 in lower U-shaped member 50 and into the nozzle assemblies 46. Plates 66 and 68 seal the front and back of each nozzle assembly 46.

Figure 6:
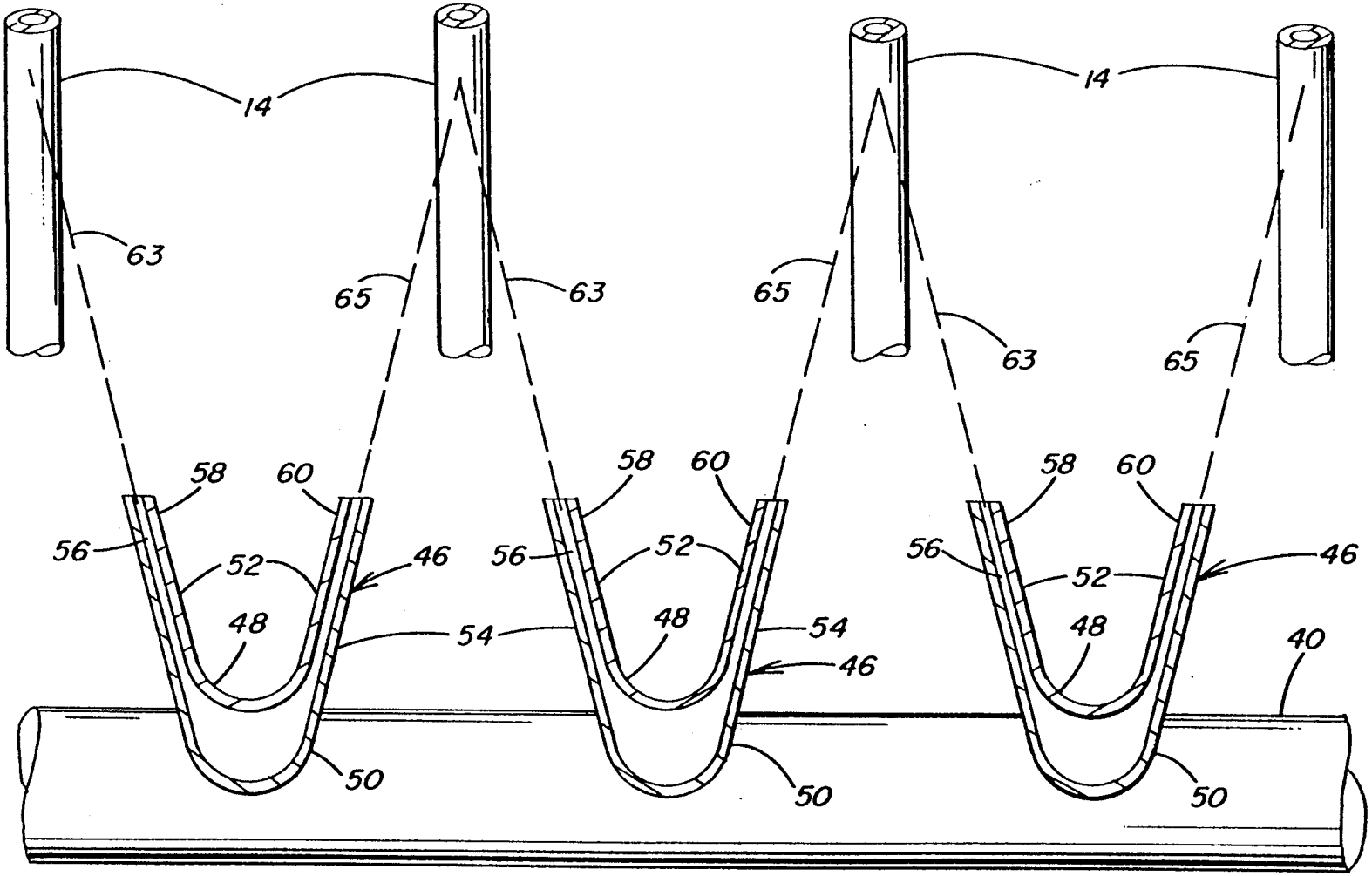
FIG. 6 is a view taken along line 6—6 of FIG. 4, with portions removed for clarity.

The nozzle assemblies 46 are inclined relative to the strand 14 as shown in FIG. 4 and nozzles 58 and 60 from adjacent nozzle assemblies 46 are inclined relative to each other such that a curtain of air from nozzle 58 of one nozzle assembly 46 represented by dotted line 63 intersects a curtain of air from nozzle 60 of adjacent nozzle assembly 46 represented by dotted line 65 along a line that generally lies in the same plane as any vertical movement of the strand 14 as it is conveyed through the drying oven 26 as illustrated in FIG. 6. Any lateral force applied to the strand 14 by one nozzle will be opposed by equal lateral force exerted by an adjacent nozzle on an adjacent nozzle assembly. Furthermore, the lateral forces from each stream of air will tend to stabilize any lateral vibration of the strand 14 as it progresses through the oven 26. In addition, the vertical forces from the air stream will be additive. In this manner, the air streams will tend to lift and support the strand 14 as it is conveyed through the oven 26 as well as tend to maintain any movement of the strand in a generally vertical plane parallel to the direction in which a strand is being conveyed through oven 26.

The length, L, of the nozzle opening 56 is a function of the angle, A, of the nozzle assembly 46 and the anticipated vertical movement, V, of the strand 14 as it is conveyed through the oven 26. In practice, length L is preferably slightly greater than V/sin A. In the preferred embodiment of the invention, angle A is 45° so that length L is slightly greater than 1.41 V. Nozzle openings 56 outside the preferred length can be sealed, for example, by welding. In addition, it is preferred that the support assembly 38 is positioned such that the nozzle openings 56 are centered along the midpoint of the expected vertical movement V of the strand 14.

Referring to FIGS. 3 and 4, an alignment plate 70 is pivotally hung from header 40 via collars 72 and is used to maintain strand alignment when the oven 26 is being rethreaded with strand 14. In particular, the plate 70 includes a plurality of spaced apart fingers 74 which are aligned with a corresponding nozzle assembly 46 such that the space 76 between pairs of fingers 74 corresponds to the space between each nozzle assembly 46 and thus the location of the strand 14 as it is conveyed through the oven 26. In practice during a rethreading operation, a rethreading bar (not shown) with the strands 14 attached thereto at their preferred spacing, is passed through the oven 26 from right to left as viewed in FIG. 1. As the bar reaches the support assembly 38, it lifts and pivots first alignment plate 70 and then nozzle assemblies 46 upward and out of the way of the bar. Referring to FIG. 4, this would be a clockwise rotation about header 40. As the bar continues through the oven 26, it passes the plate 70 allowing it to swing back into position while still lifting the nozzle assemblies 46. The fingers 74 maintain the aligned position of the strands 14 at the support assembly until the bar passes the nozzle assemblies 46 allowing them to fall back into place to their original position. A stop member 78 is positioned to limit the downward rotation of the nozzle assemblies in support assembly 38.

The present invention teaches an apparatus and method for supporting a plurality of spaced apart strands. The strand may be advancing between the nozzle assemblies 46 of the support 38 or they may be stationary. In addition, the support 38 may be used to support coated strand that is advancing through a drying and/or curing oven.

The form of the invention shown and described in this disclosure represents an illustrative preferred embodiment thereof. It is understood that various changes may be made without departing from the teachings of the invention defined by the claimed subject matter which follows.

I claim:

1. An apparatus for supporting a plurality of strands comprising:

pairs of first and second spaced apart nozzles wherein each of said pairs of nozzles are tilted generally towards each other such that a generally upwardly directed gas stream issuing from said first nozzle of each of said pairs of nozzles intersects a generally upwardly directed gas stream issuing from said second nozzle of said pair along a line;

means to support said nozzles in a generally inclined orientation;

means to allow delivery of pressurized gas to said nozzles wherein said line of intersection between gas streams from each of said pairs of first and second nozzles and a strand positioned between each of said pairs of nozzles each forms a generally vertical plane.

2. The apparatus as in claim 1 further including a plurality of adjacent nozzle assemblies each having first and second nozzles wherein said first nozzle of a first nozzle assembly is spaced from and tilted toward said second nozzle of a second nozzle assembly adjacent to said first nozzle assembly.

3. The apparatus as in claim 1 wherein said nozzles are inclined at an angle of approximately 45 degrees.

4. The apparatus as in claim 2 further including means to pivotally mount said nozzle assemblies to allow rotational movement of said assemblies about a horizontal axis generally transverse to said strand.

5. The apparatus as in claim 4 further including an alignment plate having spaced apart fingers such that the spacing between adjacent fingers generally corresponds to the spacing between said first and second nozzles on adjacent nozzles assemblies.

6. The apparatus as in claim 5 further including means to pivotally mount said alignment plate relative to said nozzle assemblies.

7. The apparatus as in claim 5 wherein each of said nozzle assemblies include a first generally U-shaped member seated within and secured to a second generally U-shaped member wherein leg portions of said first member are spaced from adjacent leg portions of said second member and further wherein said adjacent first and second member leg portions form said first and second nozzles of said nozzle assemblies.

8. The apparatus as in claim 7 wherein said support means, said pivoting means, and said delivery means includes a header member and further wherein said gas flows through said header member and out of said nozzles between said adjacent legs of said U-shaped members.

9. A method of supporting a strand comprising:

positioning a strand between a pair of first and second spaced apart nozzles;

tilting said nozzles generally towards each other such that a generally upwardly directed gas stream issuing from said first nozzle of each of said pairs of nozzles intersects a generally upwardly directed gas stream issuing from said second nozzle of said pair along a line;

supporting said nozzles in a generally inclined orientation;

providing pressurized gas to said nozzles wherein said line of intersection between gas streams from each of said pairs of first and second nozzles and a strand positioned between each of said pairs of nozzles each forms a generally vertical plane.

10. The method as in claim 9 further including the step of providing a plurality of adjacent nozzle assemblies each having first and second nozzles wherein said first nozzle of a first nozzle assembly is spaced from and tilted toward said second nozzle of a second nozzle assembly adjacent to said first nozzle assembly.

11. The method as in claim 10 further including the step of pivotally mounting said nozzle assemblies to allow rotational movement of said assemblies about a horizontal axis generally transverse to said strand.

12. The method as in claim 10 further including the steps of providing an alignment plate having spaced apart fingers and aligning said spacings between said adjacent fingers with the spacing between said first and second nozzles on adjacent nozzles assemblies.

13. The method as in claim 10 further including the steps of advancing said stand between said nozzle assemblies and orienting said nozzle assemblies such that said streams issuing from said nozzles have a horizontal component in the same direction as the advancing direction of the strand.

* * * * *